US005890835A

United States Patent [19]

Basta et al.

[11] Patent Number: 5,890,835

[45] Date of Patent: Apr. 6, 1999

[54] HYDRAULIC LIFT FOR BOATS

[75] Inventors: Samuel T. Basta, Bellevue, Wash.; Bob Koerselman, Boyden, Iowa; Steve Kleinwolterink; Mark Schmeling, both of Boyden, Iowa

[73] Assignee: Dethmers Manufacturing Company, Boyden, Iowa

[21] Appl. No.: 907,841

[22] Filed: Aug. 14, 1997

[51] Int. Cl.[6] ..... B63C 3/06; B63C 7/00

[52] U.S. Cl. ..... 405/3; 405/7; 114/44; 414/678; 187/213

[58] Field of Search ..... 405/3, 7; 114/44, 114/45, 46, 47, 48; 414/678, 917; 187/211, 213, 269; 254/10 R, 10 C, 124

[56] References Cited

U.S. PATENT DOCUMENTS

| | | | |
|---|---|---|---|
| 2,963,176 | 12/1960 | Smith | 405/3 X |
| 3,021,965 | 2/1962 | Harvey | 405/3 X |
| 3,083,540 | 4/1963 | Smith | 405/3 |
| 3,753,355 | 8/1973 | Knoch | 405/3 |
| 4,022,027 | 5/1977 | Tetzner | 405/3 |
| 4,895,479 | 1/1990 | Michaelsen et al. | 405/3 |
| 5,120,022 | 6/1992 | Kubik | 254/124 |
| 5,184,914 | 2/1993 | Basta | 405/3 |
| 5,485,798 | 1/1996 | Samoian et al. | 405/3 X |

FOREIGN PATENT DOCUMENTS

| | | | |
|---|---|---|---|
| 1219449 | 3/1986 | U.S.S.R. | 405/3 |

*Primary Examiner*—Tamara L. Graysay
*Assistant Examiner*—Jong-Suk Lee
*Attorney, Agent, or Firm*—Brian J. Laurenzo; Michael C. Gilchrist

[57] ABSTRACT

A hydraulic lift for raising a boat out of water into a raised storage position is proposed. Pivoting booms are connected to a frame that is supportable by a bed of a body of water. A boat rack is provided at an upper portion of the pivoting booms. A hydraulic cylinder is connected between the frame and a lower portion of the pivoting booms. The pivoting booms are selectively adjustable between a lowered position wherein the rack is submerged in the water and a raised storage position wherein the rack is raised above the water. The position of the pivoting booms is controlled by a ram of the hydraulic cylinder. Importantly, the pivoting booms are maintained in the raised storage position when the ram is in a retracted position which protects the ram from corrosion and fouling. In the preferred embodiment, the pivoting booms are rotated over center when they are in the raised storage position.

16 Claims, 6 Drawing Sheets

HYDRAULIC LIFT FOR BOATS

BACKGROUND OF INVENTION

This invention relates generally to lifts for boats, and more particularly to a lift that uses a hydraulic cylinder such that a ram of the cylinder retracts into the cylinder to move the lift into a raised storage position.

Devices for lifting boats out of water for storage are well known. One common design utilizes a frame that has a base which is rectangular in outline when viewed from above. Booms are pivotally attached to the base and are connected at their tops by a boat rack. The booms, the boat rack, and the base form a parallelogram when viewed from the side. The booms pivot from a position wherein the boat rack is below the water level for loading and unloading a boat, to a raised storage position wherein the boat is held above the water level. Typically a hydraulic cylinder is connected diagonally across the parallelogram between the booms and the base. As the ram of the cylinder extends, the boat rack is raised towards the storage position. As the ram of the cylinder retracts, the boat rack is lowered. An example of this design is shown in U.S. Pat. No. 3,021,965.

In the traditional design some type of locking mechanism is generally required to hold the lift in the raised position. If these locking mechanisms fail, unexpected lowering of the boat or excessive stress on the hydraulic cylinder can occur. Furthermore the locks add to the mechanical complexity and inconvenience of the lifts. A solution to these problems has been proposed in U.S. Pat. No. 4,895,479 which suggests pivoting the booms over center to a raised storage position in which the weight of the boat helps hold the lift in the storage position. This solution has effectively eliminated many of the problems of prior art lifts.

However, all the aforementioned lifts have the disadvantage of having the ram of the hydraulic cylinder extended during storage. The primary disadvantage of this arrangement is that the ram is exposed when the lift is in a raised storage position. Because most lifts are in the raised storage position the majority of the time, this means the ram is exposed the majority of the time. Exposure of the ram to the water for extended periods of time allows fouling of the ram by the growth of algae, moss, barnacles, and similar aquatic life. The possibility of rusting and corrosion of the rod are also increased by exposure to water and elements present in the water.

The difficulties encountered in the prior art and discussed above are substantially eliminated by the present invention.

SUMMARY OF THE INVENTION

Accordingly, it is an object of the present invention to provide a hydraulic boat lift in which the ram of the hydraulic cylinder is in a retracted position when the lift is in a raised storage position.

It is an object of the present invention to provide a hydraulic boat lift that has improved durability.

It is an object of the present invention to provide a hydraulic boat lift that is resistant to fouling.

It is a further object of the present invention to provide a hydraulic boat lift with a parallelogram-type frame which can hold a boat in a raised storage position which is over center and in which the hydraulic cylinder is in a retracted position protected from fouling by the water.

It is a further object of the present invention to provide a hydraulic boat lift with a rigidly supported rack which aids in loading the boat onto the lift.

By the present invention, it is proposed to meet these objectives and other more specific objectives that will become apparent as the description proceeds. To this end, a hydraulic lift is proposed for selectively raising a rack on which a boat may be supported above a body of water for storage, and for selectively lowering the boat into the body of water. The lift has a frame with a front end portion and a rear end portion. The frame is supportable by a floor of the body of water. A front pivoting boom is pivotally connected to the front portion of the frame. A rear pivoting boom is pivotally connected to the rear portion of the frame. The rack is in operable connection between upper portions of the front and rear pivoting booms. The front and rear pivoting booms pivot as a unit between a lowered position wherein the rack is in the body of water and a raised storage position wherein the rack is raised above the body of water. A hydraulic cylinder means is connected between the frame and a lower portion of at least one of the pivoting booms. The hydraulic cylinder has an extensible ram selectively movable between an extended position and a retracted position. The hydraulic cylinder means moves the pivoting booms into the raised storage position as the ram is moved into the retracted position. In the preferred embodiment, the raised storage position is an over center position.

DETAILED DESCRIPTION OF PREFERRED EMBODIMENTS

Figure 3:
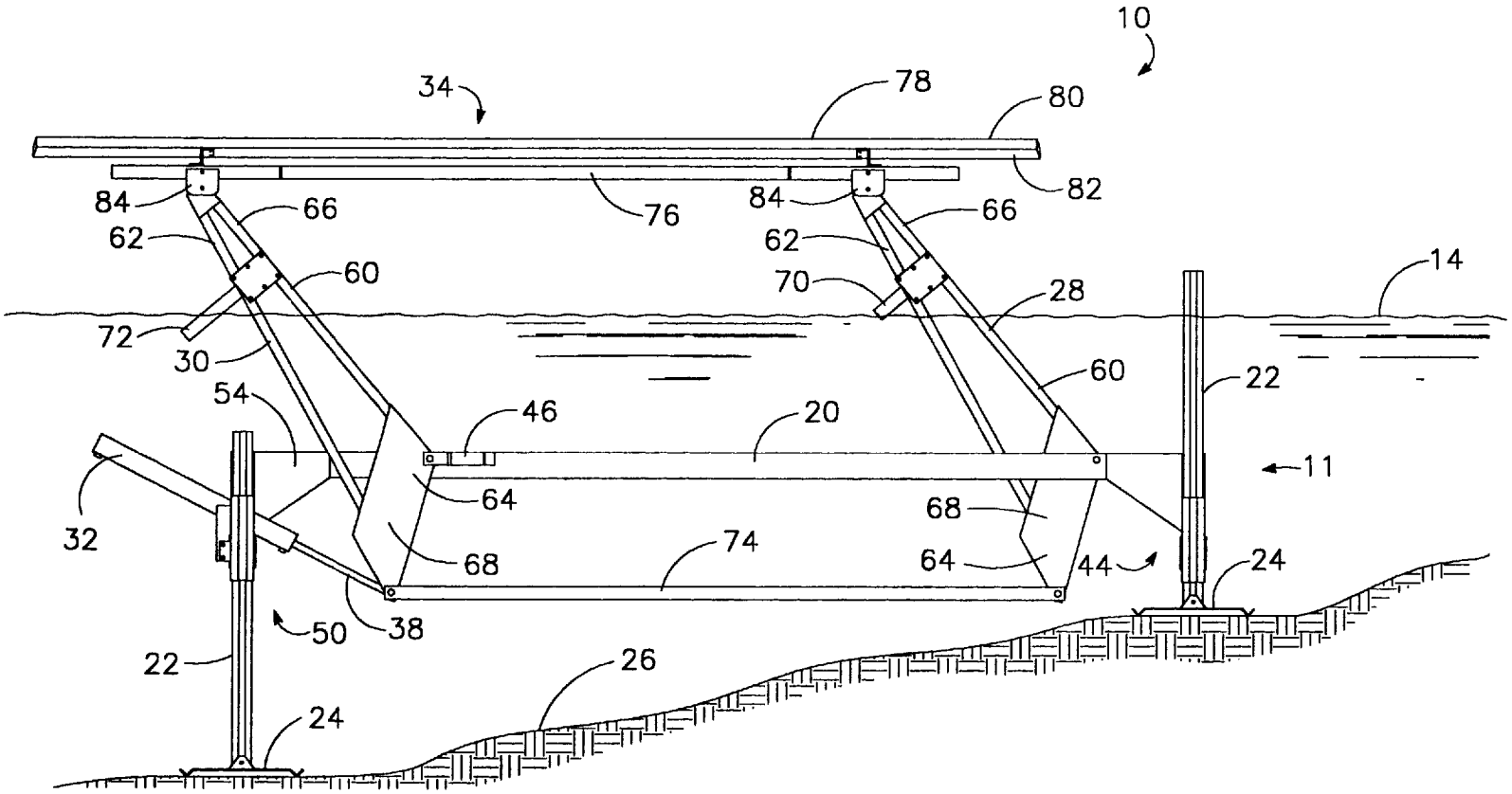
FIG. 3 is an elevation view of the preferred embodiment of the hydraulic lift of the present invention in an intermediate position.

Shown generally in the figures is a hydraulic lift 10 for raising and lowering a boat 12 into and out of a body of water 14. The hydraulic lift 10 is made up of a frame 11, four pivoting booms 28, 29, 30, 31, hydraulic cylinders 32, and a boat rack 34. A control unit 36 is used to selectively control the hydraulic cylinders 32. To raise the boat rack 34 out of the water 14, the control unit 36 is adjusted to retract rams 38 of the hydraulic cylinders 32 (see FIG. 3). To lower the boat rack 34 into the water 14, the control unit 36 is adjusted to extend the rams 38 (see FIG. 4).

The frame 11 is formed by front 16 and rear 18 transverse members, a pair of longitudinal frame members 20, legs 22, and feet 24. The feet 24 rest on a floor 26 of the body of water 14. The transverse members 16, 18 can be adjusted vertically relative to the legs 22 so that the rack 34 can be maintained in a level orientation even if the floor 26 of the body of water 14 is uneven (see FIG. 2), and so that the lift can be used in water of different depths. Similarly, the feet 24 are pivotally connected to the legs 22 so that the legs 22 can remain vertical, even if the floor 26 is sloped. The front and rear transverse members 16, 18, and the longitudinal frame members 20 of the preferred embodiment are rectangular aluminum bars. Rectangular aluminum bars are preferred because of their cost, strength, weight, and resistance to corrosion; however, persons skilled in the art will know of other shapes and materials that may be substituted. The longitudinal frame members 20 are mounted on top of the transverse members 16, 18 by uprights 58, side gussets 54, and end gussets 56. The transverse members 16, 18 extend well beyond the longitudinal frame members 20 to provide a broad base of support for the lift 10.

Figure 1:
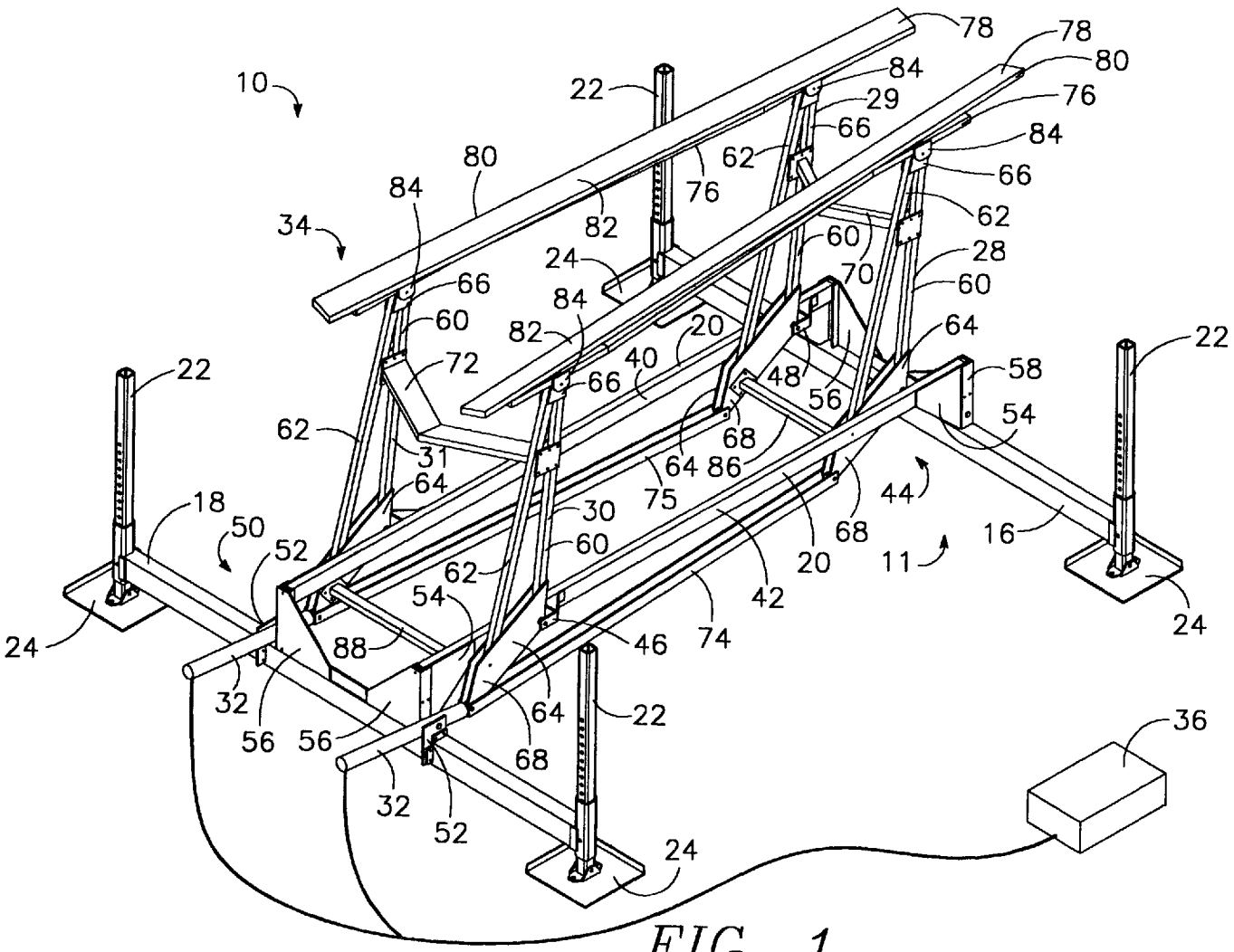
FIG. 1 is a perspective view of a preferred embodiment of the hydraulic lift for boats in accordance with the present invention in a raised storage position.

In a preferred embodiment, each of the longitudinal frame members 20 has an inside face 40 and an outside face 42. The front pivoting booms 28, 29 may be pivotally mounted on the inside faces 40 (FIG. 1) or the outside faces 42 (FIG. 6) of the longitudinal frame members 20 by front pivot brackets 48 at a front end portion 44 of the frame 11. The rear pivoting booms 30, 31 are pivotally mounted on the outside faces 42 of the longitudinal frame members 20 by rear pivot brackets 46 at a rear end portion 50 of the frame 20.

The lift has four pivoting booms: a first front pivoting boom 28, a second front pivoting boom 29, a first rear pivoting boom 30, and a second rear pivoting boom 31. The pivoting booms 28–31 each comprise three primary elements: a short pivoting arm 60, a long pivoting arm 62, and a connection brace 64. The short pivoting arm 60 and the long pivoting arm 62 are joined together at an upper portion 66 of each pivoting boom 28–31. The short pivoting arm 60 and the long pivoting arm 62 diverge from each other away from the upper portion 66. The connection brace 64 connects the diverging ends of the long pivoting arm 62 and the short pivoting arm 60 at a lower portion 68 of each pivoting boom 28–31. The short pivoting arm 60 is pivotally connected to the longitudinal frame member 20 at the connection brace 64 of each pivoting boom 28–31.

Figure 4:
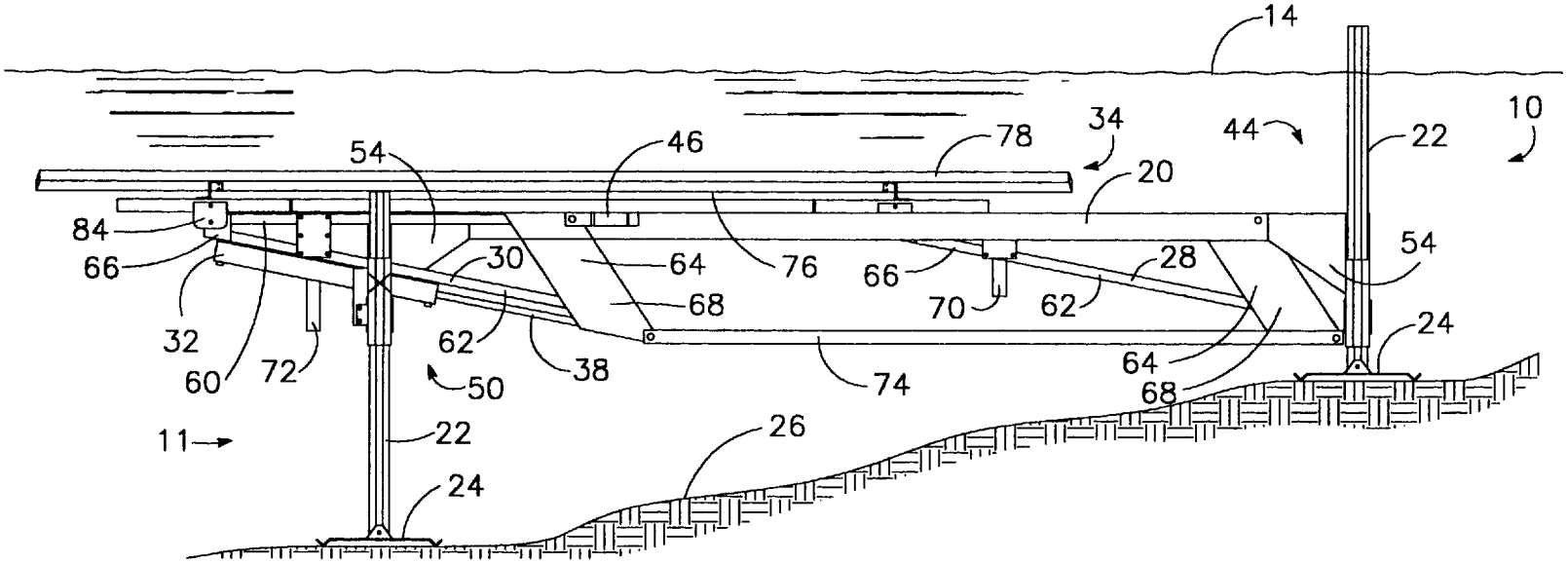
FIG. 4 is an elevation view of the preferred embodiment of the hydraulic lift of the present invention in a lowered position.

An upper front pivoting booms brace 70 is in operable connection between the front pivoting booms 28, 29, and an upper rear pivoting booms brace 72 is in operable connection between the rear pivoting booms 30, 31. The upper pivoting booms braces 70, 72 add stability and rigidity to the boat rack 34 when a boat 12 is loaded. The pivoting booms braces 70, 72 are "V" shaped to allow for the hull of a loaded boat 12 when the pivoting booms 28–31 are in a lowered position (FIG. 4). A lower front pivoting booms brace 86 is in operable connection between the connection braces 64 of the front pivoting booms 28, 29. A lower rear pivoting booms brace 88 is in operable connection between the connection braces of the rear pivoting booms 30, 31. These lower pivoting booms braces 86, 88 provide added stability and rigidity to the lift when the boat 12 is loaded on the lift 10. The lower rear pivoting booms brace 88 serves the further purpose of preventing the pivoting booms 28–31 from pivoting past the raised storage position by wedging against the longitudinal members 20.

Each hydraulic cylinder 32 is pivotally mounted on top of the rear transverse member 18 between a trunnion plate 52 and an upright 58. The pivotal mounting of the hydraulic cylinder 32 allows the cylinder 32 to act on the pivoting booms 30, 31 as the pivoting booms 30, 31 swing through an arc. The control unit 36 is connected to a pump (not shown) which regulates the pressure of hydraulic fluid within the cylinders 32. The preferred hydraulic fluid is one that is biodegradable and therefore will not harm the water environment in case of a leak or rupture. Paraffinic white mineral oil has been found suitable for use as the hydraulic fluid. Those skilled in the art will also know of other hydraulic fluids that would be satisfactory.

The ram 38 of each hydraulic cylinder 32 is pivotally connected to the lower portion 68 of a corresponding rear pivoting boom 30, 31. A first longitudinal lower pivoting boom link 74 connects the lower portion 68 of the first rear pivoting boom 30 to the lower portion 68 of the first front pivoting boom 28. A second longitudinal lower pivoting boom link 75 connects the lower portion 68 of the second rear pivoting boom 31 to the lower portion 68 of the second front pivoting boom 29. These longitudinal lower pivoting boom links 74,75 transmit the force of the hydraulic cylinders 32 to the front pivoting booms 28, 29. The hydraulic cylinders 32 are double-acting cylinders which are capable of applying force to the rear pivoting booms 30, 31 by placing the ram 38 in either compression or tension. This double-action of the cylinders 32 allows the cylinders 32 to push the rack 34 from the lowered position toward the raised storage position and allows the cylinders 32 to pull the rack 34 from the over-center storage position toward the lowered position. The combination of the double-acting cylinder and the over-center position eliminates the need for any locking means to retain the rack 34 in the raised storage position.

Figure 6:
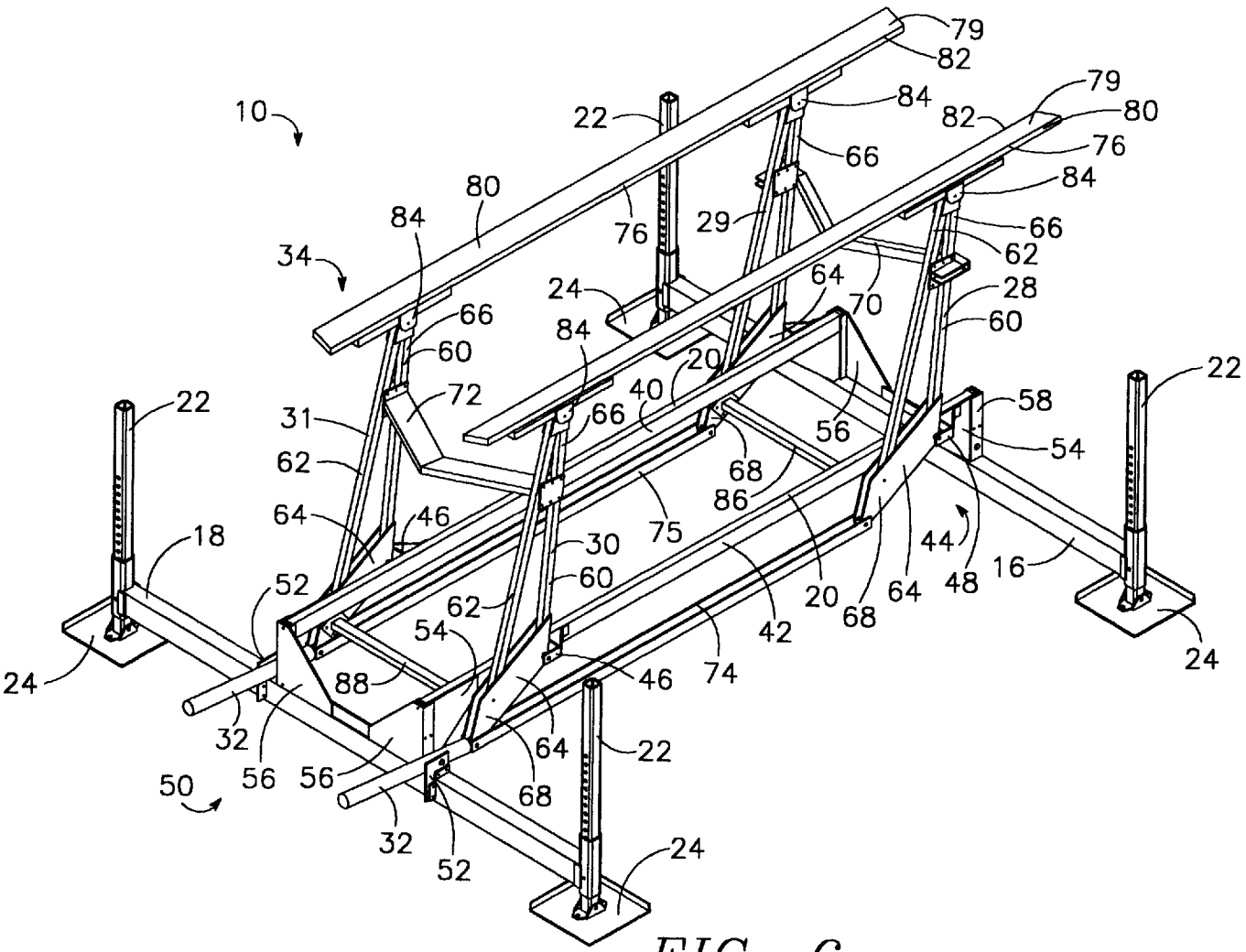
FIG. 6 is a perspective view of an alternative design for the hydraulic lift of the present invention in a raised storage position with parallel bunk boards rather than angled bunk boards.

The boat rack 34 comprises longitudinal rack beams 76 and angled bunk boards 78. The longitudinal rack beams 76 are pivotally mounted to the upper portions 66 of the pivoting beams 28–31. The angled bunk boards 78 are attached to the longitudinal rack beams 76 by rack brackets 84. The angled bunk boards 78 provide the support surface for the boat 12. The angled bunk boards 78 are tilted from a higher outside edge 80 to a lower inside edge 82 to match the contours of a typical hull of the boat 12. The longitudinal rack beams 76 and the angled bunk boards 78 are angled inward from rear to front of the lift 10. Angling the bunk boards 78 from rear to front, aids in loading the boat 12 onto the rack 34. Because the front pivoting beams 28, 29 are mounted to the inside faces 40 of the longitudinal frame members 20 and the rear pivoting beams 30, 31 are mounted to the outside faces 42 of the longitudinal frame members 20, the angled bunk boards 78 can be supported on the pivoting beams 28–31 with a minimum of bracing. As an alternative to angled bunk boards, parallel bunk boards 79 (FIG. 6) may be used. If parallel bunk boards 79 are used, the front pivoting booms 28, 29 may be mounted to the outside faces 42 of the longitudinal frame members 20 rather than the inside faces 40, as shown in FIG. 6, so that all the pivoting booms 28–31 are mounted on outside faces 42; or, all the booms 28–31 may be mounted to the inside faces 40 (not shown).

The use of two hydraulic cylinders 32 rather than one is advantageous because it puts less point stress on the frame 11 than a single hydraulic cylinder would. The force to move the pivoting booms 28–31 can be applied directly to the booms 28–31, without the need to add a cross piece for the application of the force.

It is contemplated that the lift 10 will be used primarily near the shore of the body of water 14, preferably in close proximity to a deck. To use the lift 10 to hoist a boat 12 out of the water 14, the lift is adjusted with the control unit 36 so that the pivoting booms 28–31 are in the lowered position (FIG. 4). When the pivoting booms 28–31 are in the lowered position, the rams 38 of the hydraulic cylinders 32 are extended, and the angled bunk boards 78 of the boat rack 34 are submerged below the surface of the water 14. The boat is then moved into alignment with the angled bunk boards 78. Preferably, the bunk boards are at the proper depth so that the boat 12 is supported slightly by the bunk boards 78 even in the lowered position, and at a depth such that the boat 12 is at a level proximate to the level of the dock (not shown). The lift 10 may be equipped with a centering device which extends above the surface of the water to help in proper alignment of the boat with the lift 10. Such centering devices will be well known to those skilled in the art. The boat 12 is then moved forward onto the bunk boards 78. When the boat is centered over the bunk boards 78, the control unit 36 is adjusted to cause the rams 38 to retract into the hydraulic cylinders 32. As the rams 78 retract, the lift 10 moves from the lowered position of FIG. 4 through a partially raised position shown in FIG. 3 until the rams 78 are fully retracted as shown in FIG. 2.

Figure 2:
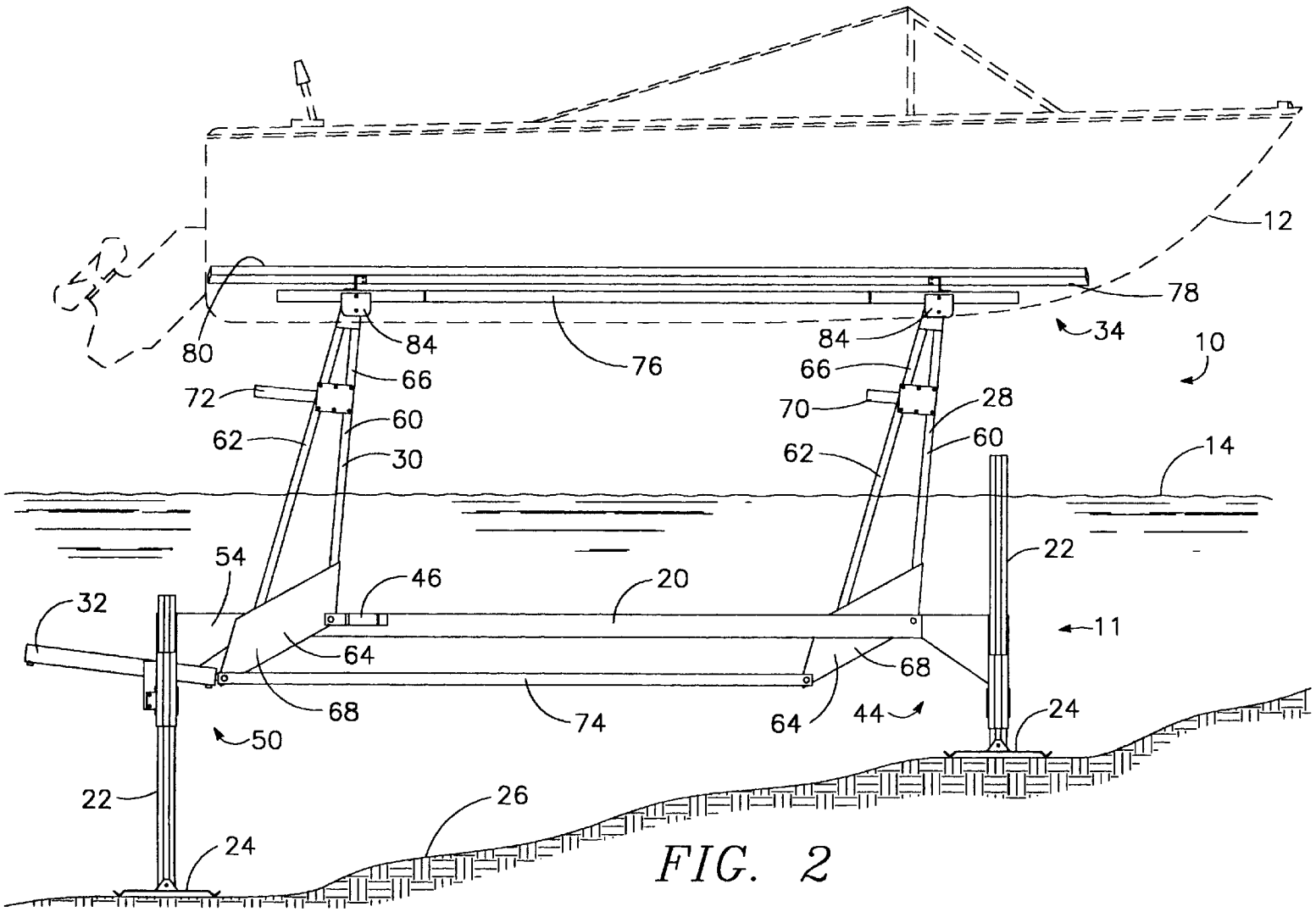
FIG. 2 is an elevation view of the preferred embodiment of the hydraulic lift for boats in accordance with the present invention in a raised storage position.
Figure 5:
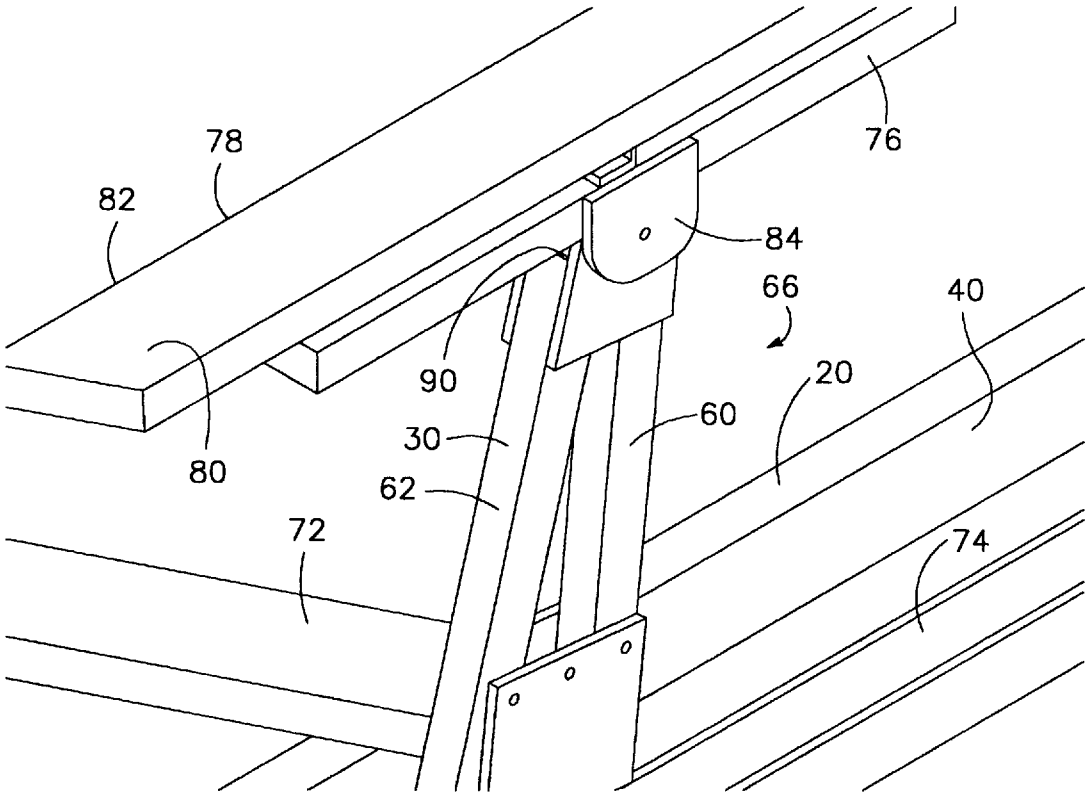
FIG. 5 is a detail perspective view of the rear portion of the preferred embodiment of hydraulic lift of the present invention in a raised storage position.

When the rams 78 are fully retracted into the hydraulic cylinders 32, the lift 10 is in a raised storage position shown in FIG. 2. In the raised storage position, the pivoting booms are rotated over center, such that the short pivoting arms 60 have rotated past a vertical orientation. It should be appreciated that the pivoting booms 28–31 are in an "over center" orientation when the overall load of the booms 28–31, the rack 34, and the watercraft 12 are rotated over center such that the weight of the load tends to urge the upper portions 66 of the pivoting booms 28–31 toward the front end 44 of the frame 11 rather than the rear end 50 of the frame 11. The pivoting booms 28–31 are prevented from rotating past the storage position by three mechanisms. First, an upper edge 90 of each long pivoting arm contacts a bottom surface 92 of the corresponding longitudinal rack beam 76. (FIG. 5). Second, as noted above, the lower rear pivoting booms brace 88 wedges against the longitudinal members 20. Finally, the ram 38 of the hydraulic cylinder 32 is retracted as far as it can go, and the hydraulic cylinder 32 prevents the pivoting booms 28–31 from continuing past the raised storage position. Furthermore, the cylinder is in a fully retracted position and will not allow the pivoting booms 28–31 to continue rotation past the raised storage position. Because the pivoting booms 28–31 are rotated over center, the weight of the boat 12 and the boat rack 34 tend to hold the lift 10 in the raised storage position. No sustained force need be applied by the hydraulic cylinders 32 to retain the lift 10 in the raised storage position.

The foregoing description and drawings merely explain and illustrate preferred embodiments of the invention and the invention is not limited thereto, except insofar as the claims are so limited. Those skilled in the art, who have the disclosure before them, will be able to make modifications and variations therein without departing from the scope of the invention. For example, while it is contemplated that the structural components will be made primarily of aluminum, other materials may be substituted without departing from the claims.

What is claimed is:

1. A hydraulic lift for raising a rack in which a boat may be supported above a body of water for storage of the boat out of the water and for selectively lowering the rack into the body of water, the hydraulic lift comprising a hydraulic cylinder for use while submerged in the body of water, said hydraulic cylinder having a ram for raising and lowering said rack, said ram being movable between a retracted position wherein said ram is substantially insulated from the body of water and an extended position wherein said ram is exposed to the body of water, the rack being in a raised storage position when said ram is in said retracted position.

2. The lift according to claim 1, wherein said hydraulic cylinder is a double-acting hydraulic cylinder that pushes said ram toward said extended position and pulls said ram towards said retracted position.

3. The lift according to claim 1, wherein said lift further comprises pivoting booms attached to the rack, and wherein said pivoting booms are rotated to an over center orientation by said ram in said retracted position when said rack is in said raised storage position.

4. The lift according to claim 3, further comprising a frame having a front end portion and a rear end portion, said frame being supportable by a floor of said body of water, said pivoting booms each being pivotally connected to said frame at pivot points on said pivoting booms, said pivoting booms each having an upper portion generally above said pivot points, said pivoting booms each having a lower portion generally below said pivot points, said upper portions of said pivoting booms being operably connected to said rack, said hydraulic cylinder being operably connected between said lower portion of one said pivoting booms and said rear end portion of said frame such that as said ram is moved toward said retracted position said rack moves generally toward said front end portion of said frame.

5. The lift according to claim 4, wherein said pivoting booms comprise a front pivoting boom and a rear pivoting boom.

6. The lift according to claim 5, further comprising a longitudinal link member in connection between said lower portions of said front pivoting boom and said rear pivoting boom.

7. The lift according to claim 4, wherein said pivoting booms comprise a pair of front pivoting booms and a pair of rear pivoting booms, wherein said frame comprises a front transverse member at said front end portion of said frame, a rear transverse member at said rear end portion of said frame, and a pair of longitudinal frame members, wherein said longitudinal frame members each have an inside face and an outside face, wherein said rear pivoting booms are pivotally connected to said outside faces proximate to said rear end portion of said frame, wherein said front pivoting booms are pivotally connected to said inside faces proximate to said front end portion of said frame, and wherein said hydraulic cylinder is connected to said frame at said rear transverse member.

8. The lift according to claim 4, wherein said rack comprises bunk boards in supported lignment with said upper portions of said pivoting booms.

9. A hydraulic lift for selectively raising a rack in which a boat may be supported above a body of water for storage of the boat out of the water and for selectively lowering the rack into the body of water, the hydraulic lift comprising:

a frame having a front end portion and a rear end portion, said frame being supportable by a floor of said body of water;

a front pivoting boom pivotally connected to said front end portion of said frame at a pivot point on said front pivoting boom, said front pivoting boom having an upper portion generally above said pivot pint of said front pivoting boom and a lower portion generally below said pivot point of said front pivoting boom, said upper portion of said front pivoting boom being connected so the rack;

a rear pivoting boom pivotally connected so said rear end portion of said frame at a pivot point on said rear pivoting boom, said rear pivoting boom having an upper portion generally above said pivot point of said rear pivoting boom and a lower portion generally below said pivot point of said rear pivoting boom, said upper portion of said rear pivoting boom being connected to the rack, said front and rear pivoting booms being pivotal as a unit between a lowered position and a raised storage position; and a hydraulic cylinder means connected between said frame and said lower portion of at least one of said pivoting booms, said hydraulic cylinder having an extensible ram selectively movable between an extended position wherein said ram is extended from said cylinder such that said ram is exposed to the body of water and a retracted position wherein said ram is substantially retracted into said cylinder such that said ram is substantially insulated from the body of water, said pivoting booms being in said lowered position when said ram is in said extended position, and said hydraulic cylinder means moving said pivoting booms into said raised storage position when said ram is moved to said retracted position.

10. The hydraulic lift according to claim 9, wherein said hydraulic cylinder is a double-acting hydraulic cylinder that can pull said pivoting booms toward said raised storage position by pulling on said lower portions of said pivoting booms and push said pivoting booms toward said lowered position by pushing on said lower portions of said pivoting booms.

11. The hydraulic lift according to claim 9, wherein said pivoting booms are in an over center orientation when said pivoting booms are in said raised storage position.

12. The hydraulic lift according to claim 9, further comprising a second front pivoting boom and a second rear pivoting boom, wherein said frame comprises a front transverse member, a rear transverse member and a pair of longitudinal frame members, wherein said longitudinal frame members each have an inside face and an outside face, wherein said rear pivoting booms are pivotally connected to said frame at said outside faces of said longitudinal frame members, and wherein said front pivoting booms are pivotally connected to said frame at said inside faces of said longitudinal frame members.

13. The hydraulic lift according to claim 12, wherein the rack comprises a pair of bunk boards angled to aid in loading the boat and in supported alignment with said upper portions of said pivoting booms.

14. The hydraulic lift according to claim 12, further comprising a front pivoting booms brace in connection between said front pivoting booms to provide increased stability and rigidity to the lift when the boat is loaded, said front pivoting booms brace having a "V" shape to allow room for the boat on the rack when said booms are in said lowered position.

15. The hydraulic lift according to claim 12, further comprising a rear pivoting booms brace in connection between said rear pivoting booms to provide increased stability and rigidity to the lift when the boat is loaded, said rear pivoting booms brace having a "V" shape to allow room for the boat on the rack when said booms are in said lowered position.

16. A hydraulic lift for selectively raising a rack in which a boat may be supported above a body of water for storage of the boat out of the water and for selectively lowering the rack into the body of water, the hydraulic lift comprising:

a frame having front end portion and a rear end portion, a front transverse member at said front end portion, a rear transverse member at said rear end portion, and a first and a second longitudinal frame member running between said transverse members, each said longitudinal frame member having an inside face and outside face, said frame being supportable by a floor of said body of water;

a first front pivoting boom pivotally connected to said inside face of said first longitudinal frame member at said front end portion of said frame at a pivot point on said first front pivoting boom, said first front pivoting boom having an upper portion generally above said pivot point of said first front pivoting boom and a lower portion generally below said pivot point of said first front pivoting boom, said upper portion of said first front pivoting boom being connected to the rack;

a second front pivoting boom pivotally connected to said inside face of said second longitudinal frame member at said front end portion of said frame at a pivot point on said second front pivoting boom, said second front pivoting boom having an upper portion generally above said pivot point of said second front pivoting boom and a lower portion generally below said pivot point of said second front pivoting boom, said upper portion of said second front pivoting boom being connected to the rack;

a first rear pivoting boom pivotally connected to said outside face of said first longitudinal frame member at said rear end portion of said frame at a pivot point on said first rear pivoting boom, said first rear pivoting boom having an upper portion generally above said pivot point of said first rear pivoting boom and a lower portion generally below said pivot point of said first rear pivoting boom, said upper portion of said first rear pivoting boom being connected to the rack, said first front pivoting boom and first rear pivoting boom being pivotal as a unit between a lowered position and a raised storage position;

a second rear pivoting boom pivotally connected to said outside face of said second longitudinal member at said rear end portion of said frame at a pivot point on said second rear pivoting boom, said second rear pivoting boom having an upper portion generally above said pivot point of said second rear pivoting boom and a lower portion generally below said pivot point of said second rear pivoting boom, said upper portion of said second rear pivoting boom being connected to the rack, said second front pivoting boom and second rear pivoting boom being pivotal as a unit between a lowered position and a raised storage position;

a front pivoting booms brace in connection between said front pivoting booms to provide increased stability and rigidity to the lift when the boat is loaded, said front pivoting booms brace having a "V" shape to allow room for the boat on the rack when said booms are in said lowered position;

a rear pivoting booms brace in connection between said rear pivoting booms to provide increased stability and rigidity to the lift when the boat is loaded, said rear pivoting booms brace having a "V" shape to allow room for the boat on the rack when said booms are in said lowered position;

a pair of bunk boards angled to aid in loading the boat and in supported alignment with said upper portions of said pivoting booms; and a hydraulic cylinder means connected between said frame and said lower portion of at least one of said pivoting booms, said hydraulic cylinder having an extensible ram selectively movable between an extended position wherein said ram is extended from said cylinder and a retracted position wherein said ram is substantially retracted into said cylinder, said pivoting booms being in said lowered position when said ram is in said extended position, and said hydraulic cylinder means moving said pivoting booms into said raised storage position wherein said pivoting booms are rotated over center when said ram is moved to said retracted position.

* * * * *